US006450804B2

(12) United States Patent
Vallomy

(10) Patent No.: US 6,450,804 B2
(45) Date of Patent: Sep. 17, 2002

(54) COMPACT CONTINUOUS CHARGING APPARATUS

(75) Inventor: John A. Vallomy, Concord, NC (US)

(73) Assignee: Techint Compagnia Tecnica Internazionale, Milan (IT)

( * ) Notice: Subject to any disclaimer, the term of this patent is extended or adjusted under 35 U.S.C. 154(b) by 0 days.

(21) Appl. No.: 09/892,343

(22) Filed: Jun. 27, 2001

Related U.S. Application Data

(60) Provisional application No. 60/214,525, filed on Jun. 27, 2000.

(51) Int. Cl.[7] ..... F27D 3/00

(52) U.S. Cl. ..... 432/239; 432/109; 432/243; 373/79; 373/80

(58) Field of Search ..... 432/86, 87, 109, 432/117, 215, 239, 242, 243; 373/78, 79, 80; 266/901; 75/10.63, 10.66

(56) References Cited

U.S. PATENT DOCUMENTS 3,152,795 A * 10/1964 Eichelberg et al. ..... 432/86
3,721,519 A * 3/1973 Venetta ..... 432/239
3,758,267 A * 9/1973 Berk ..... 266/901
3,896,257 A * 7/1975 Kinoshita ..... 373/79
4,543,124 A 9/1985 Vallomy ..... 75/46
4,681,537 A 7/1987 Vallomy ..... 432/242
4,836,732 A 6/1989 Vallomy ..... 414/188
5,497,978 A * 3/1996 Yamashiro et al. ..... 266/901
5,800,591 A 9/1998 Vallomy ..... 75/10.63
6,155,333 A 12/2000 Vallomy ..... 164/476

* cited by examiner

*Primary Examiner*—Gregory A. Wilson
(74) *Attorney, Agent, or Firm*—Dougherty & Clements LLP

(57) ABSTRACT

An improved method and apparatus for charging, preheating and refining steel. The charging apparatus has a skirted charging section for introducing charge materials, a dynamic gas seal adjacent the charging section and a preheater, the preheater for preheating the charged materials, a connector adjacent the preheater and removably insertable into an electric arc furnace for feeding charged materials into a furnace bath for melting and refining metallic charge therein, and a vibrating conveyor which extends throughout the charging apparatus. The charging apparatus is positioned on rails to be movable by a hydraulic cylinder between a charging position wherein the connector is fully inserted into the furnace, a retracted position where the connector is partially inserted into the furnace and a disconnected position where the connector is fully removed from the furnace.

17 Claims, 10 Drawing Sheets

Fig.11
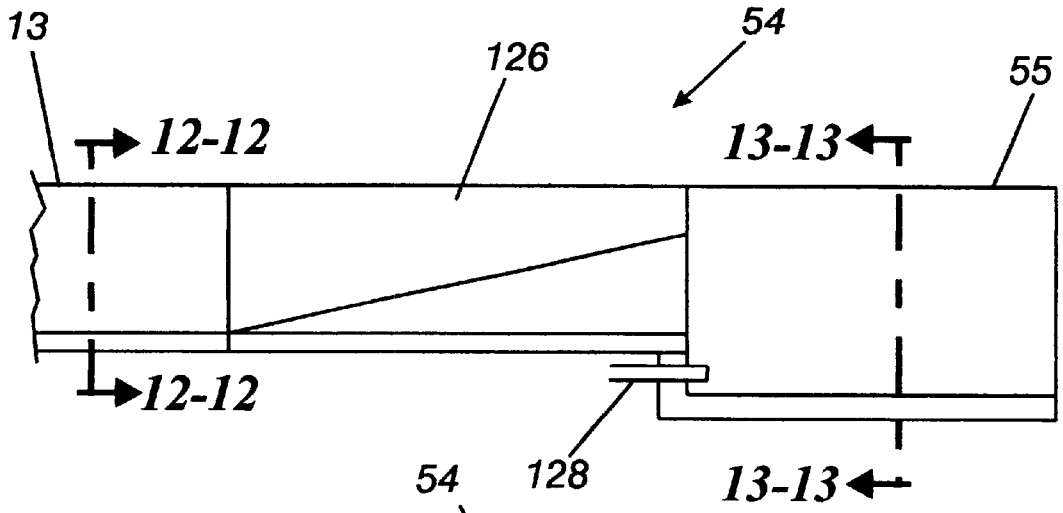
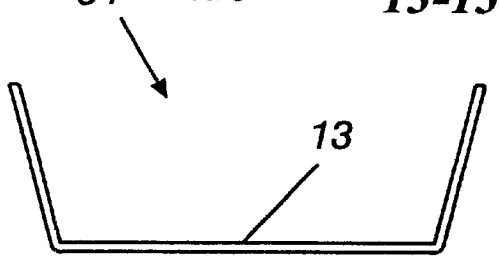
Fig.12
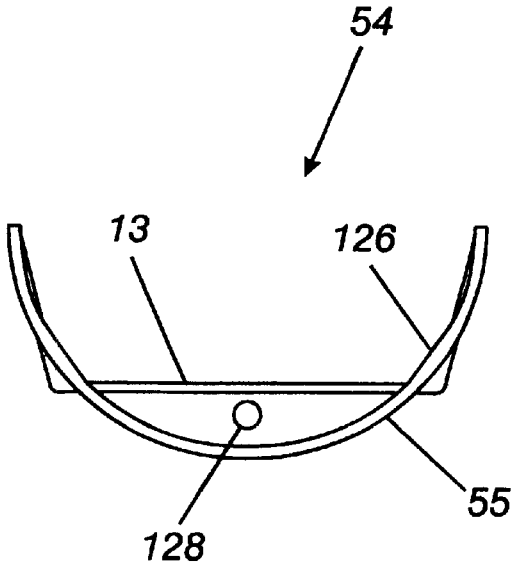
Fig.13

COMPACT CONTINUOUS CHARGING APPARATUS

CROSS REFERENCE TO RELATED APPLICATION

This application claims the benefit of U.S. Provisional Application No. 60/214,525, filed on Jun. 27, 2000.

FIELD OF THE INVENTION

The present invention relates to the production of steel from raw materials, and particularly to a method and apparatus for continuous electric arc furnace steelmaking and foundries having minimal emissions and electrical energy demand while maximizing steel or iron production in mini-mills and foundries. The invention is ideally suited for providing energy conservation and environmental protection while maximizing production.

The existing CONSTEEL Process and Apparatus, as described in U.S. Pat. No. 6,155,333 to Vallomy, requires two conveyors, a connecting car and ample space to achieve the above objectives and is most suitable for foundries having a high feed capacity. However, the CONSTEEL apparatus is may be cost prohibitive for smaller foundries and mini-mills in the feed capacity range of 23–35 tons per hour. Furthermore, smaller foundries and mini-mills may not have sufficient space to accommodate the CONSTEEL apparatus.

BACKGROUND OF THE INVENTION

The production of steel and steel products, or products that incorporate steel therein, are essential to the maintenance and growth of many economies in various parts of the world. The acquisition and installation of steel refining facilities depend on a number of important considerations including environmental impact, cost efficiency and available space. The manufacture of steel using an electric arc furnace (EAF) is a highly advantageous process in the modem steel industry because of the flexibility of the EAF in using mixes of different charge materials including liquid hot metals and the ability to produce substantially all known grades of steel.

One approach to refining steel is the use of continuous EAF charging, melting and refining systems having side feeding of the EAF, such as described in U.S. Pat. No. 6,155,333 ('333) (the CONSTEEL apparatus and method), U.S. Pat. No. 4,543,124 ('124) and U.S. Pat. No. 5,800,591 ('591). The systems described in the '333, '124 and '591 patents provide continuity to the preheating of charge materials, the melting of charge materials, and the refinement of steel. Such continuous preheating, melting and refining systems incorporate furnaces having a furnace design that accommodate side feeding and off gas extraction at low gas flow velocities so that particulate entrained in the off gas falls out in the preheater. In these systems, a charging pan is located about a material entry opening in the side of the furnace. Charge material is introduced from the pan into the furnace, and CO rich off gas is transferred to the charge preheater to be used as a fuel for preheating purposes. The systems described in the '333, '124 and '591 patents are energy conservative.

However, mini-mills and foundries have a limited space and limited production which make the CONSTEEL Continuous Preheating System or a mere overall reduction in length thereof, cost prohibited and consequently an unsuitable method and apparatus. What is needed is an improved method and apparatus for preheating, melting, and refining steel that is compatible with limited capacity facilities. Further needed is a method and apparatus for preheating, melting, and refining steel that permits side feeding into a furnace without requiring an increase in the furnace height and maintains the consistency of charge feeding.

Continuous steel preheating, melting and refining systems that have side feeding use equipment that interface with the furnace, such as a connecting car, is described in U.S. Pat. Nos. 4,681,537, 4,836,732 and '591. Such equipment is prone to damage by heat and abrasion and require periodic maintenance. For example, the connecting car pan is exposed to the splash of molten steel and slag and to high temperature peaks of off gas. Consequently, the refining process may be interrupted by downtime required for the repair and maintenance of the connecting car.

What is needed is a method and apparatus for preheating, melting and refining steel in mini-mills and foundries that is cost effective at limited production rates and which facilitates repair and maintenance of charge feeding equipment that interface with the furnace.

SUMMARY OF THE INVENTION

The present invention is an improved method and apparatus for continuous electric steelmaking. The invention permits side feeding into a furnace without requiring an increase in the furnace height and allows repair and maintenance of connecting means that directly feeds charge materials to the furnace with less downtime. Additionally, the present invention also simply and quickly allows the connecting means to be interchangably positioned within a furnace opening in a charging position, partially positioned in the furnace opening in a retracted position for top charging the production of alloyed speciality steel, and fully withdrawn from the opening for quick repair and maintenance of the apparatus.

The invented apparatus for continuous preheating of an iron-bearing material, and melting and refining of steel in a metal-producing furnace comprises an elongate conveyor having a front, intermediate and rear section. The conveyor is mounted on a frame having wheels for longitudinal movement toward and from the furnace. A loading section is disposed at the front segment for receiving charge materials. A covered and thus generally closed preheater for preheating the charge materials on the conveyor is disposed at the intermediate segment. A connecting means is disposed at the rear section of the conveyor, longitudinally moveable with the conveyor, and configured to longitudinally and removably insert into the furnace opening.

Additionally, the invented apparatus for continuous preheating of an iron-bearing material, and melting and refining of steel in a metal-producing furnace comprises a conveyor for receiving charge materials, a covered and thus closed preheater for preheating the charge materials on the conveyor, a metal treating furnace for melting and refining a metallic charge. a connecting means removably coupled to the preheater and to the charge conveyor for directly feeding charge materials into a furnace bath, the connecting means being a round tubular member having a horizontal centerline, the furnace being tiltable about an axis of rotation coinciding substantially with the centerline of the connecting means, and the conveyor being mounted on wheels for longitudinal movement toward and from said furnace.

The connecting means comprises a quickly retractable connector having a substantially semi-circular or semi-round charging pan situated therein. The furnace comprises a shell that may be either a single or split shell structure, a furnace roof having vertical openings for receiving electrodes and the round charging opening. The charging opening has a top half positioned in the roof and a bottom half in an upper shell portion thereby accommodating a low furnace height.

The connector forms the terminal end of the conveyor adjacent to the preheater and is retractable with the conveyor along rails on which the feeding system is mounted. The retractable connector and split entry furnace opening facilitate and simplify the repair and maintenance of the connector to minimize steel producing downtime.

The invented method and apparatus improves mini-mill steel refining systems as well as foundry production.

OBJECTS OF THE INVENTION

A principal object of the present invention is to provide an improved apparatus for preheating, melting, and refining steel that conserves energy and protects the environment.

Another, more particular object the present invention is to provide a charging apparatus comprising a loading section, a preheater, a connecting means for engaging an opening of a furnace, and a conveyor extending the length of the charging apparatus for advancing charge materials to the furnace.

Another object of the present invention is for the conveyor to be mounted on wheels which moveably engage rails for longitudinally moving the charging apparatus away from and towards the furnace to a charging, retracted or disconnected positions.

Another object of the present invention is for the connecting means to be substantially round with a horizontal centerline, and for the connecting means to longitudinally and removably be insertable into furnace opening.

Another object of the present invention is for the conveyor to be supported by a frame, the loading section to be provided with a skirt and the preheater provided with a hood; and for the skirt and hood to be removably attached to the frame so that the skirt and hood longitudinally move with the charging apparatus away from and towards the furnace to the charging, retracted or disconnected positions.

Another object of the present invention is to further include a dynamic gas seal positioned between the loading section and the preheater.

Another object of the present invention is to include a burner in the preheater to supplement the preheating capability of the furnace off gas, if needed.

BRIEF DESCRIPTION OF THE DRAWINGS

The foregoing and other objects will become more readily apparent by referring to the following detailed description and the appended drawings in which:

FIG. 11 is a side elevation of the conveyor transition segment wherein the trapezoidal conveyor transitions into the semi-round conveyor and further showing a conduit for introducing particulate additives or gaseous materials to conveyed materials.

FIG. 12 is a cross sectional view of the transition segment taken along line 12—12 of FIG. 11 in the direction from the charging area towards the furnace.

FIG. 13 is a cross sectional view of the conveyor transition segment taken along line 13—13 of FIG. 11 in the direction from the furnace towards the charging area.

DETAILED DESCRIPTION

The present invention is an improved method and apparatus for continuous electric arc furnace melting in foundries producing steel or cast iron and in mini-mills of low production capacity. The present invention is advantageous for use in steelmaking facilities which have limited space and limited feed capacity. In particular, the present invention provides a cost-effective method and apparatus for producing steel in smaller foundries and mini-mills having a limited feed capacity, preferably less than 60 tons per hour, and more preferably in the range of 23–35 tons per hour, with similar production capacities.

Figure 1:
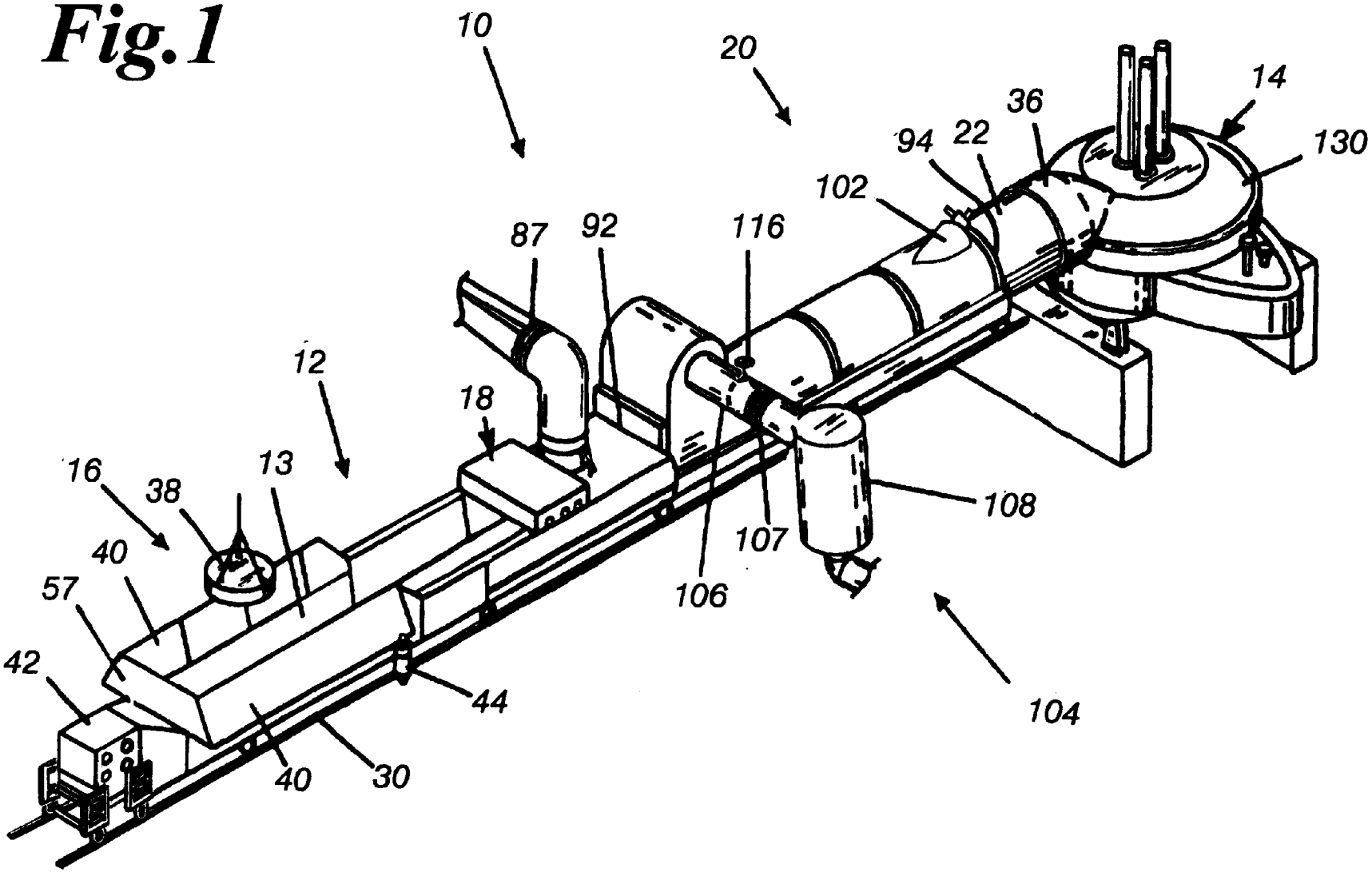
FIG. 1 is a perspective view of a preferred embodiment of the invented apparatus showing a charging apparatus in a charging position with a connector inserted into the furnace.
Figure 2:
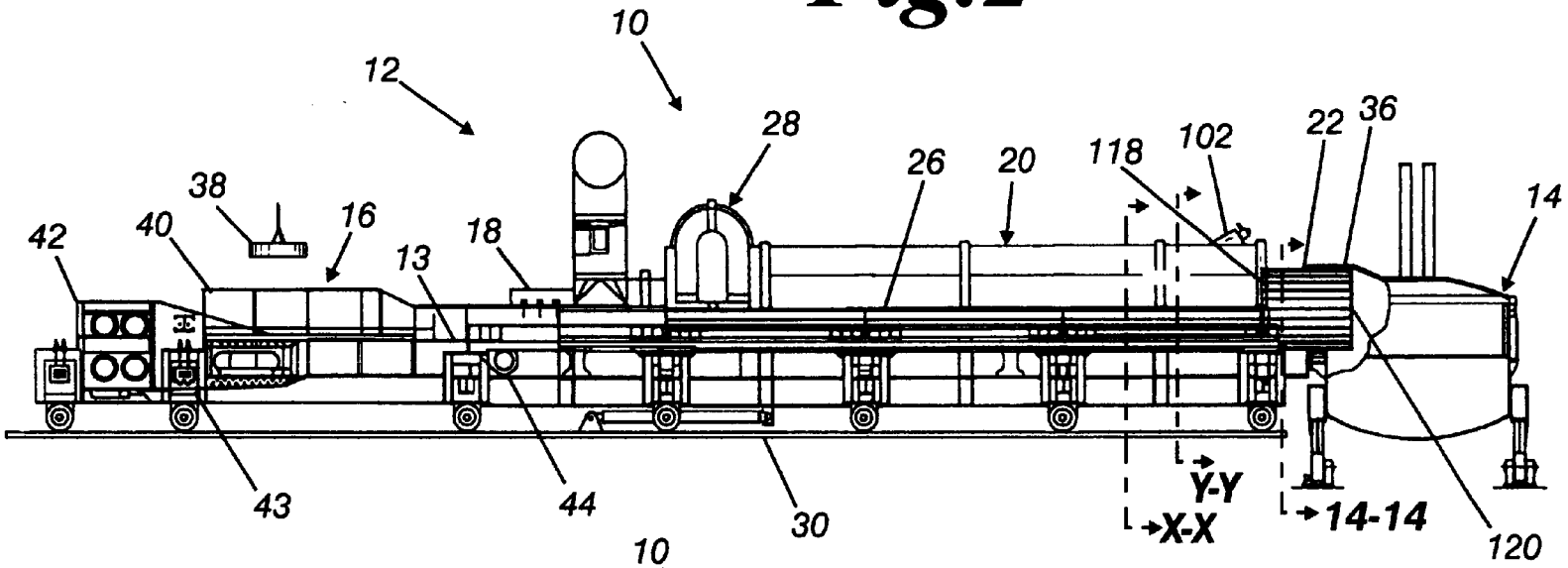
FIG. 2 is a side elevation of the embodiment of FIG. 1 showing the charging apparatus in a charging position with the furnace partially cut-away to show the connector fully inserted into the furnace shell.
Figure 4:
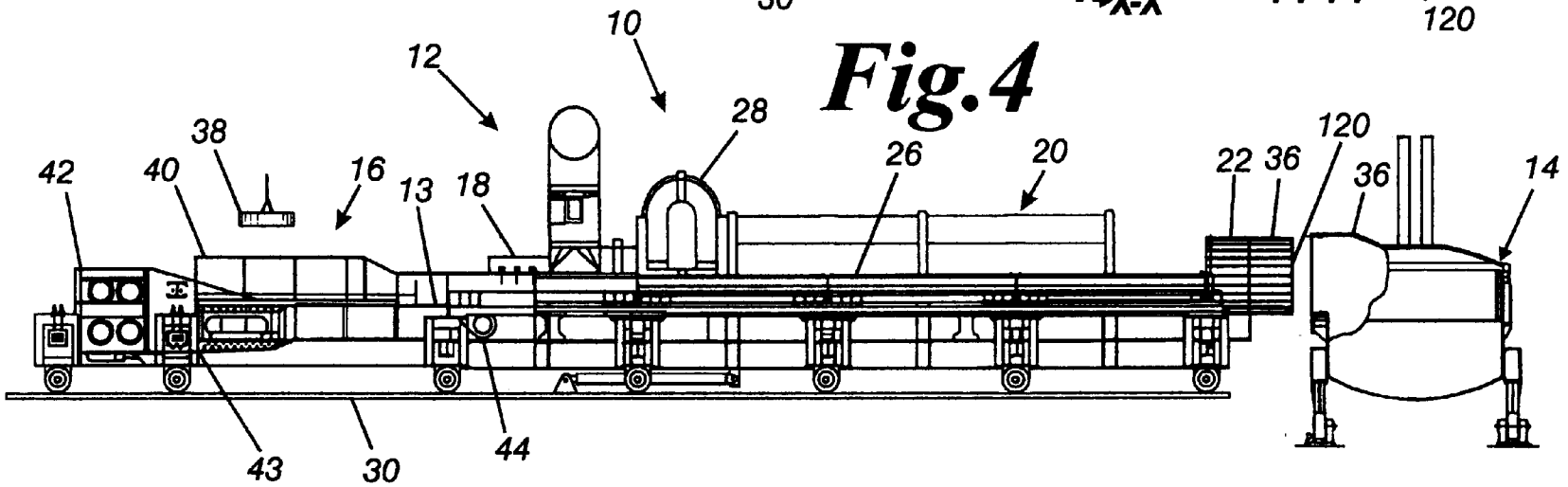
FIG. 4 is a side elevation of the embodiment of FIG. 1 showing a preheater having a hood removed and the charging apparatus in a disconnected position with the connector fully withdrawn from the furnace.
Figure 3:
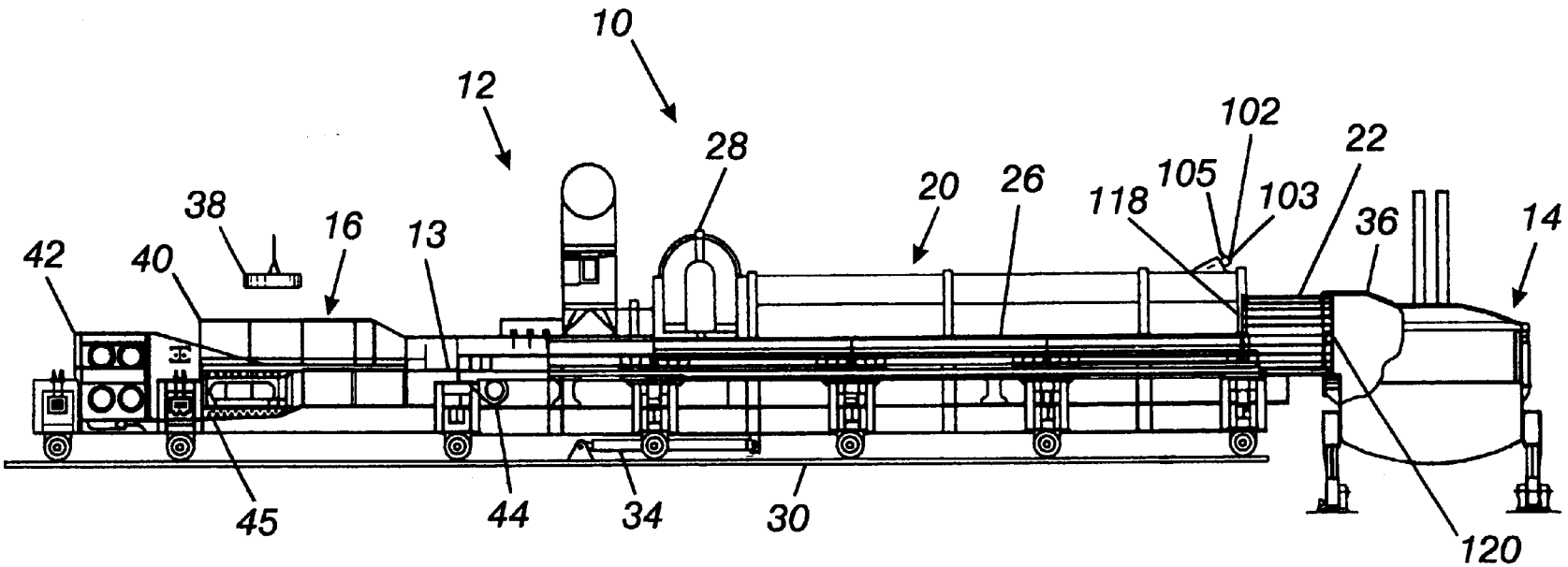
FIG. 3 is a side elevation of the embodiment of FIG. 1 showing the charging apparatus in a retracted position with the connector furnace partially cut-away to show the connector partially inserted into the furnace.

Referring now to the figures, and in particular to FIG. 1, an improved apparatus for continuous electric steelmaking, shown generally at 10, comprises a charging apparatus 12 having a vibrating conveyor 13 which extends the length of the charging apparatus 12 for delivering charge materials to a furnace 14, preferably an electric arc furnace. The charging apparatus 12 includes a skirted loading section 16 for receiving charge material, a dynamic gas seal 18 that is coupled to both the loading section 16 and a preheater 20 which preheats the charged materials, and a connector 22 coupled to and forming a terminal discharge end of the conveyor 13. The connector 22 is removably insertable into the electric arc furnace 14 for feeding charged materials into a bath 24 (FIG. 15) of the electric arc furnace 14 wherein the metallic charge is melted and refined. As shown in FIGS. 2–4, the charging apparatus 12 is movably mounted on rails 30 and is positioned by a pair of hydraulic cylinders 34 (FIG. 3) between a charging, retracted and disconnected position. The charging apparatus 12 may additionally include a hot off gas treatment system 104 to comply with emission regulations.

The charging apparatus 12 is mounted on the rails 30 to be movable by the hydraulic cylinders 34 between the charging, retracted and disconnected positions, respectively shown in FIGS. 2–4. In the charging position, the connector 22 is fully engaged a maximum predetermined distance within a material entry opening 36 of the electric arc furnace 14 for charging the electric arc furnace 14 and wherein the connector 22 collects and delivers off gases from the furnace 14 to the preheater 20. In the retracted position, shown in FIG. 2, the charging apparatus 12 is moved away from the furnace 14 so that the connector 22 partially engages the material entry opening 36 of the electric arc furnace 14 a distance less than the maximum predetermined distance. The retracted position is particularly useful for speciality alloyed steel production in which the charging apparatus 12 continues to provide additives to the furnace 14 and collects off gases from the furnace 14. In the rectracted position, the connector 22 is sufficiently retracted from the furnace 14 to be protected from damage. In the disconnected position, the charging apparatus 12 is further moved from the furnace 14 so that the connector 22 is fully withdrawn from the furnace material opening 36. The disconnected position is used for maintenance of the connector 22, as well as for other parts of the charging apparatus 12 and furnace 14.

The charging apparatus 12 has two hydraulic cylinders 34, shown in FIG. 3, for moving the charging apparatus 12 from one to another of the charging, retracted and disconnected position. The hydraulic cylinders 34 have a first end secured to the ground and an opposing end coupled to the charging apparatus 12 for longitudinally moving the charging apparatus 12 along the rails 30 to any of the three positions. The hydraulic cylinders 34 drive the charging apparatus 12 over a range of about one meter to move the charging apparatus 12 to each of the three positions. An alternative method to move the charging apparatus 12 between positions is to couple the charging apparatus 12 to a locomotive that is movable along the rails 30 so that the apparatus 12 moves with the locomotive.

Charge materials are transported by the raw material handling equipment 38 and deposited onto the vibrating conveyor 13. The loading section 16 includes a skirt 40 positioned above, and extending along the lateral sides 41 of, the vibrating conveyor 13 to direct the charged materials transported by the raw material handling equipment 38 onto the vibrating conveyor 13. The vibrating conveyor 13 forwardly advances the charge material by longitudinally moving a short distance forward before jerking rearward leaving the charge materials at the forward location. The vibrating motion of the conveyor 13 is effectuated by an engine 42, coupled to the charging apparatus 12 by piston members 43, which deliver a pulsing force to the conveyor 13. Although the vibrating conveyor 13 is preferred, other suitable conveyors can be uses such as an endless conveyor.

Additionally, the loading section 16 may be provided with a deduster 44 that is attached to the bottom of the vibrating conveyor 13 for collecting particles, such as dirt, from the charged material on the conveyor 13. Preferably, the conveyer 13 has a configuration which allows egress of minute particles, to which the deduster 44 is coupled, to allow particles within the charged material to fall through the conveyor 13 for collection by the deduster 44 as the charged materials advance toward the furnace 14.

Figure 5:
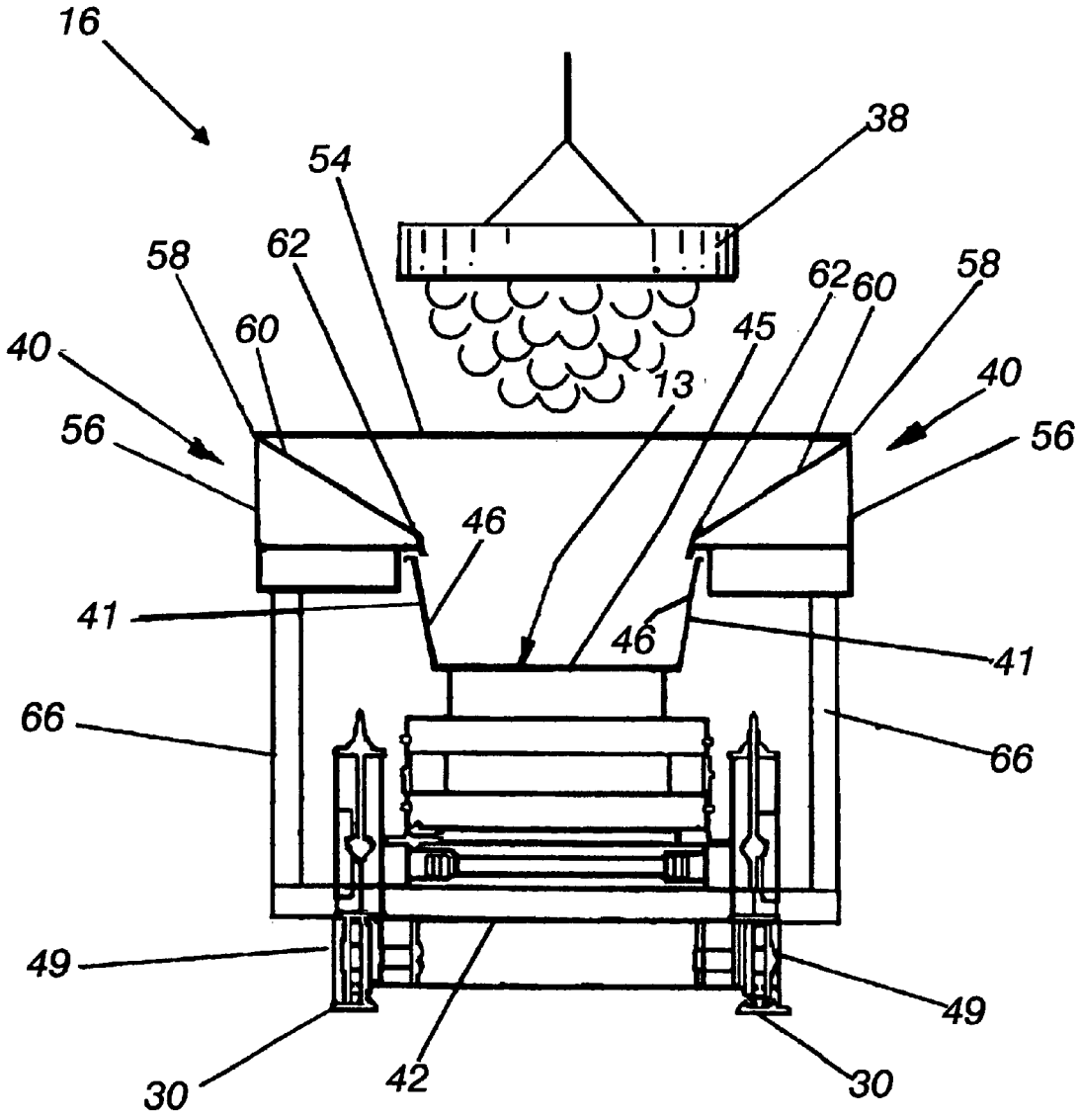
FIG. 5 is cross sectional view of a loading section of the charging apparatus having an elongate vibrating channel with a trapezoidal cross section comprising a flat bottom and inclined sides.

FIG. 5 is a cross sectional view of the loading section 16 shown in FIG. 1 utilizing a generally trapezoidal vibrating conveyor 13, and more specifically, having a pan with a flat bottom 45 and inclined sides 46. The skirt 40 is positioned for funneling charge material to the conveyor 13. The vibrating conveyor 13 is attached to, and supported by, a wheeled frame 48 which movably engages the rails 30. The frame 48 is provided with a series of wheels 49 which reside atop the pair of parallel rails 30 for longitudinal movement of the charging apparatus 12 between the charging, retracted and disconnected positions.

When using the trapezoidal conveyor 13, a transitional segment 54 is used to transition the trapezoidal conveyor 13 to a semi-circular conveyor 55 (that is, a conveyor having a semicircular pan), as shown in FIGS. 11–13 and further described below, for interfacing with the rounded connector 22. Alternatively, the semi-circular conveyor 55, illustrated in FIG. 6, can be used throughout the charging apparatus 12 without use of the transitional segment 54. The semi-circular conveyor 55 is supported by the wheeled frame 48 and cooperates with the skirt 40 as does the trapezoidal conveyor 13 of FIG. 5.

Figure 6:
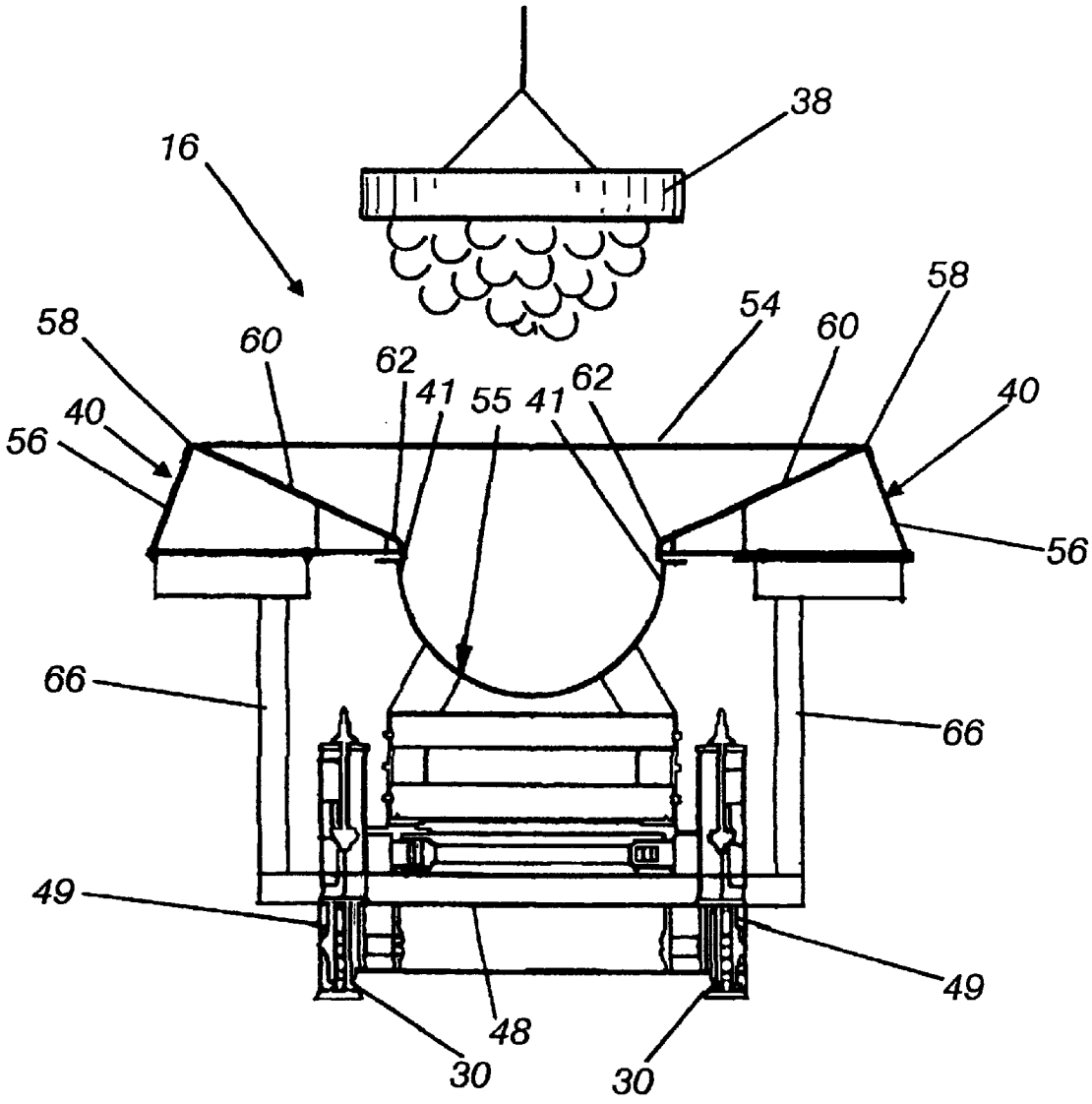
FIG. 6 is a cross sectional view of the loading section of the charging apparatus having an elongated vibrating channel with a semi-circular cross section.

Illustrated in FIGS. 1, 5–6, the skirt 40 has an end wall 57 positioned at the upstream end of the conveyor 13 and side sections 56 which extend along the lateral sides 41 of the conveyor 13 to a point before the dynamic gas seal 18. The side sections 56 of the skirt 40 are triangular shaped with an apex 58 disposed above and lateral to the conveyor 13 and an inner side 60 sloping downward to an inner terminal end 62 positioned slightly above the lateral sides 41 of the conveyor 13 to direct charge material to the conveyor 13. A support structure extends downward from the skirt 40 to securely couple the skirt 40 to the frame 48. The support structure 66 can be a series of vertical support beams.

When loading charged material onto the conveyor 13 the raw material handling equipment 38 is positioned overhead the conveyor 13 in order that the skirt 40 may direct the scrap material onto the conveyor 13. At times, the scrap fed in the loading section 16 may exceed a desired scrap bed height. Removal of the charge materials that exceed the desired scrap bed height can be performed by the raw material handling equipment 38, such as a mobile crane with a magnet, by lowering the raw material handling equipment 38 between the skirt apexes 58 to access the charge materials in the conveyor loading section 16. Thus, the material handling equipment 38 can assist in maintaining the homogenity of the scrap bed and a continuity of the overall steel production process. The material handling equipment 38 or other material handling means can be used to add smaller charge materials and additives to the conveyor 13 underneath or on top of the large charge materials that are loaded onto the conveyor 13 by the raw material handling equipment 38. This aides in maintaining the density of the charge which is particularly useful for controlling the overall melting-refining process.

Figure 7:
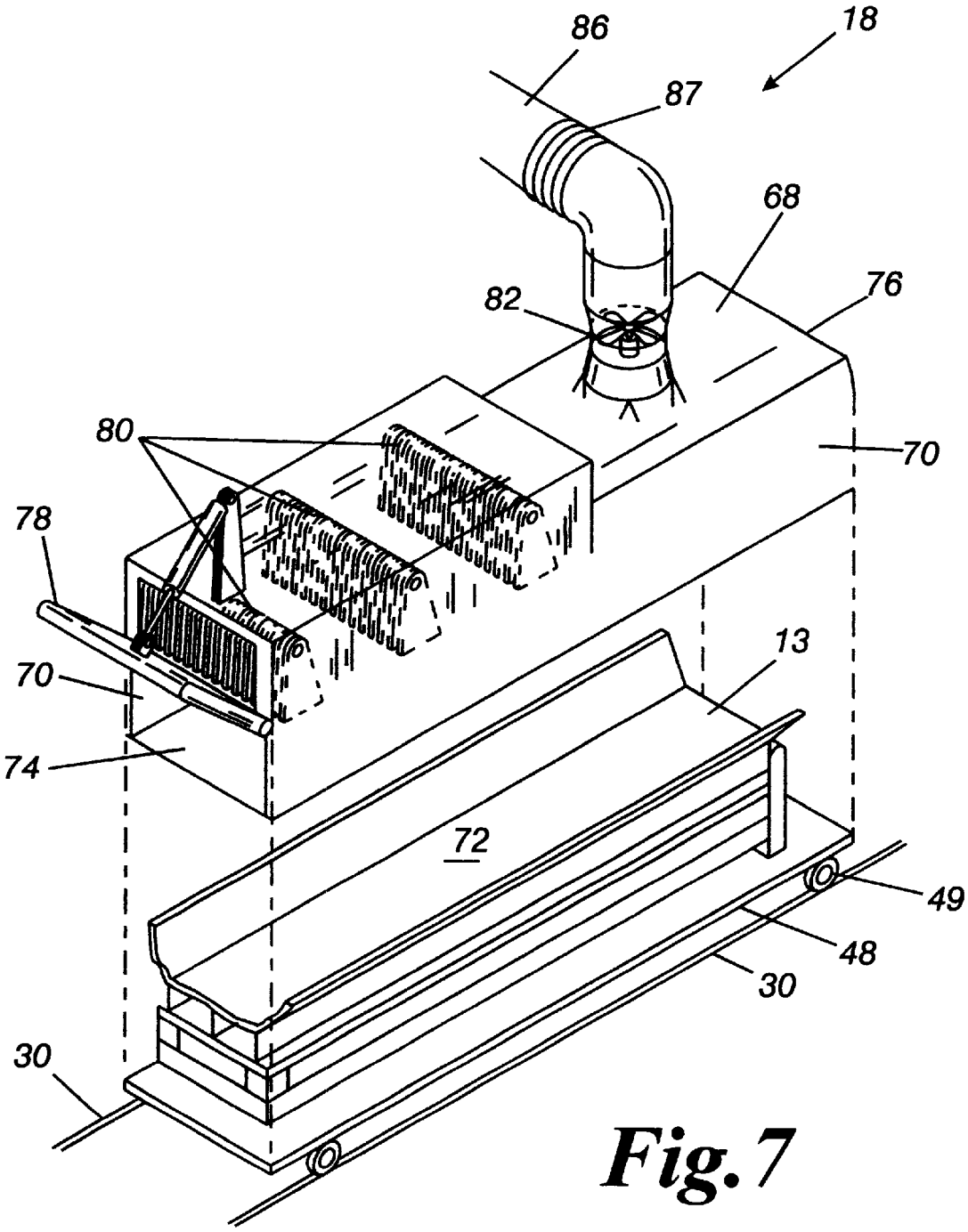
FIG. 7 is a partially exploded perspective view of a dynamic gas seal.

The dynamic gas seal 18, as shown in FIG. 7, comprises a gas seal hood 68 with sides 70 that laterally enclose the conveyor 13. The dynamic gas seal sides 70 are attached to the wheeled frame 48, and in combination with the seal hood 68 and conveyor 13 define a seal chamber 72 which encloses the charge material. The seal hood 68 can be removed to facilitate repair and maintenance of the charging apparatus 12.

The dynamic gas seal 18 has an entrance 74 and an exit 76 to allow charge material transported by the conveyor 13 to move therethrough. The dynamic gas seal 18 additionally includes a push-down plate 78 that is positioned at the entrance 74 of the gas dynamic seal 18, a plurality of mechanical curtains 80 that are positioned between the dynamic gas seal entrance 74 and exit 76, and a variable speed blower 82 that is positioned between the curtains 80 and the dynamic seal exit 76. The dynamic gas seal 18 preferably limits air intake to the preheater 20 during the continuous preheating of charge materials.

The gas seal hood 68 along with the conveyor 13 substantially encloses the dynamic seal portion 18 of the vibrating conveyor 13 to maintain a negative pressure therein. The push-down plate 78 directs obtruding scrap material down against the scrap bed of the conveyor 13 as the charge material is advanced towards the furnace 14. The push-down plate 78 may be actuated by a switch which is controlled either by a human operator or by a height monitor.

The variable speed blower 82 is responsive to differential pressure measurements of the sealing chamber 72 and controls the amount of air entering through the dynamic gas seal 18. The combination of the curtains 80 and the variable speed blower 82 assist in creating a required negative pressure within the dynamic seal 18. The curtains 80 provide obstruction to the exchange of air from outside of the dynamic seal 18 to the interior of the dynamic seal 18. In particular, the curtains 80 and variable speed blower 82 facilitate the control of the required negative pressure in the dynamic seal 18 to minimize air intake therein, shortens the time and power that is needed to reach the required negative pressure, and shortens the response time of the invented apparatus to changes of the negative pressure in the preheater 20.

A cyclone (not shown) may optionally be attached to the variable speed blower 82 via a flexible conduit 86 to remove dust from the air taken from the dynamic seal 18 by the variable speed blower 82. The flexible conduit 86 has selected flexible portions 87 which freely accommodate the charging apparatus 12 being moved between the charging, retracted and disconnected positions while the cyclone remains at a fixed position on the ground. Alternatively, the cyclone can be provided with wheels positioned on tracks (not shown) to move with the charging apparatus 12.

Figure 8:
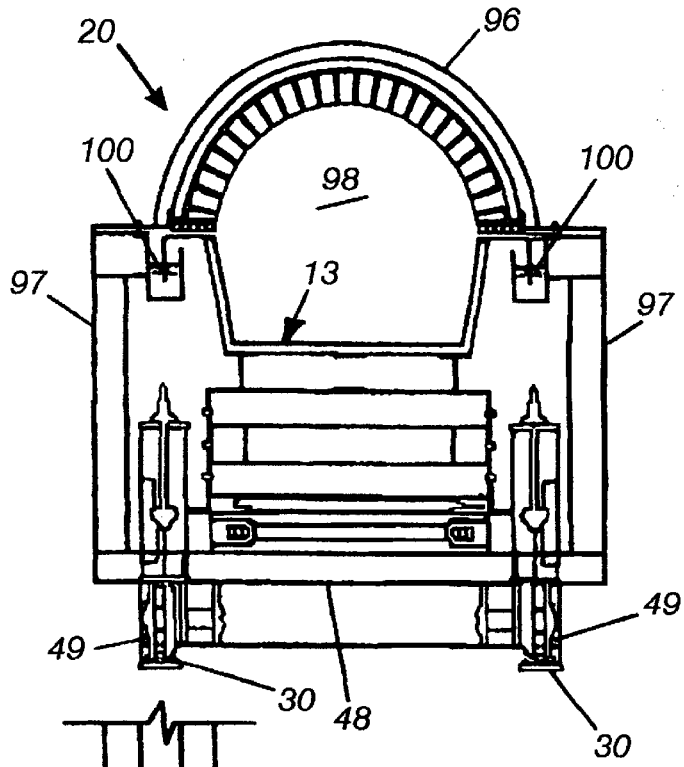
FIG. 8 is a cross sectional view of the preheater having the trapezoidal vibrating conveyor taken along line X—X of FIG. 2.
Figure 14:
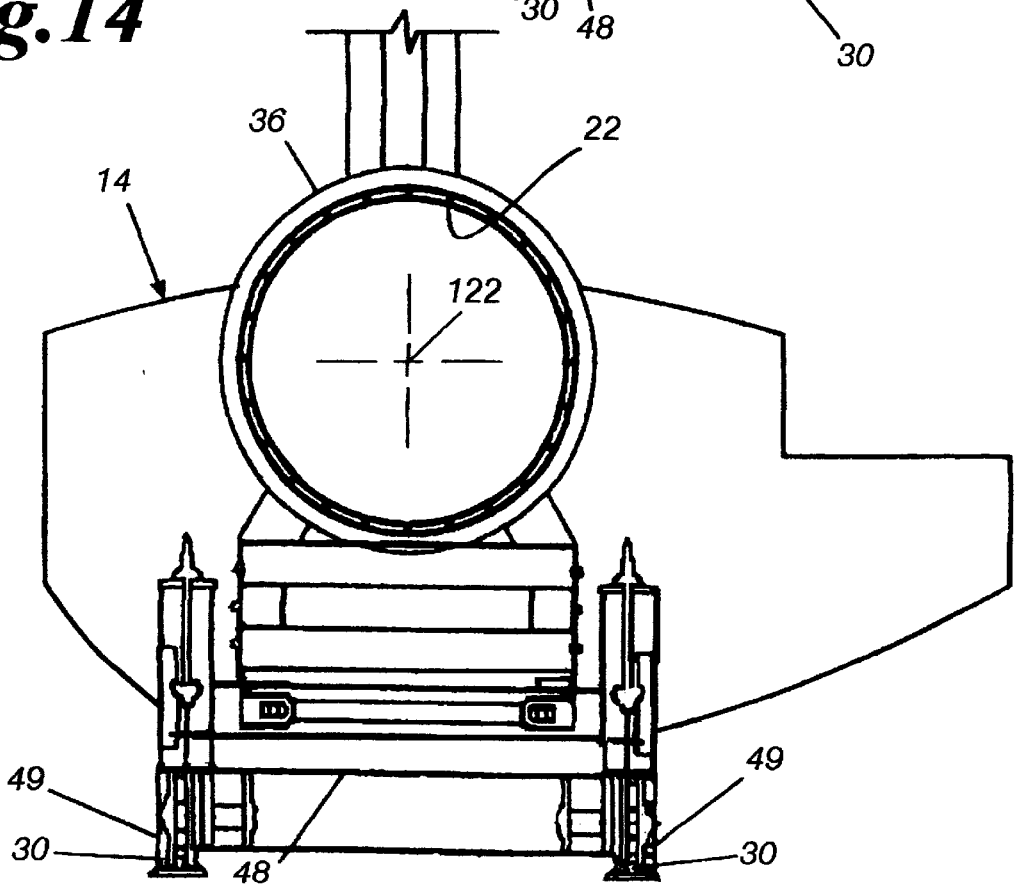
FIG. 14 is a cross sectional view of the connector inserted into a furnace material entry, taken along line 14—14 of FIG. 2.
Figure 9:
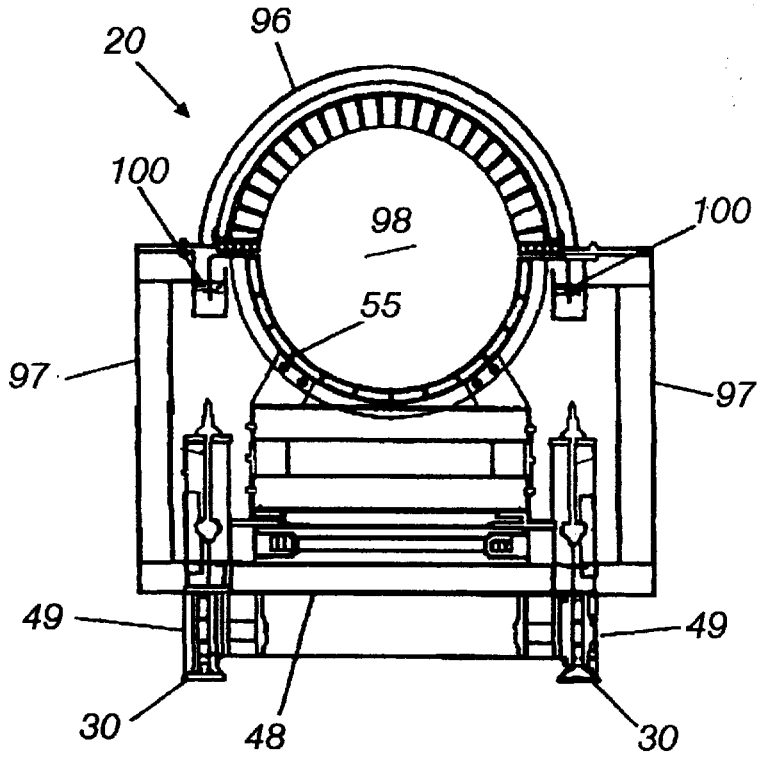
FIG. 9 is a cross sectional view of the preheater having the semi-circular charge conveyor taken along line X—X of FIG. 2.
Figure 10:
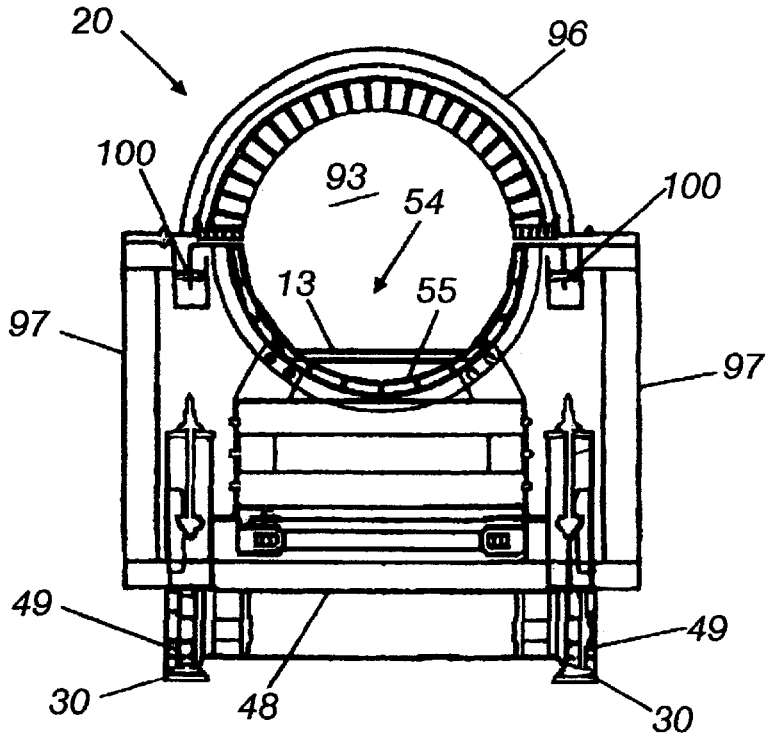
FIG. 10 is a cross sectional view of the preheater having a conveyor transition segment for transitioning the vibrating conveyor from the trapezoidal configuration to the semi-circular configuration, taken along line Y—Y of FIG. 2.

The preheater 20, shown in FIG. 1, includes a material entrance 92 and a material exit 94 to allow charge materials transported by the conveyor 13 to move therethrough. As shown in FIGS. 8–10, the preheater 20 includes a hood 96 having vertical support beams 97 which extend from the wheeled frame 48 to support a preheater hood 96 above the conveyor 13. The hood 96 and conveyor 13 form a substantially enclosed preheater chamber 98. The hoods 96 are removable to facilitate repair and maintenance of the charging apparatus 12.

The hood 96 is preferably refractory lined or water cooled. The conveyor 13 is also preferably water cooled. The conveyor 13 can be trapezoidal or semi-circular in configuration as respectively illustrated in FIGS. 8 and 9. A water seal 100 is provided at the interface between the hood 96 and the conveyor 13 to strip pollutants from escaping from the preheater chamber 98. Additionally, since the preheater 20 has a reduced length, an air-gas burner 102 (FIGS. 1–4) with optional variable oxygen enrichment is provided in the preheater hood for introducing combustion air into the preheater chamber 98 adjacent to the connector to supplement the preheating capability of the EAF off gas. The burner 102 has respective openings 103, 105 for the introductions of fuel and air for producing the combustion air.

Referring to FIG. 1, the off gas treatment system 104 for removing particulate and other pollutants is attached adjacent the entrance 92 to the preheater 20 by a flexible conduit 106. The flexible conduit 106 has selected flexible portions 107 which freely allow the treatment system 104 to remain in a fixed location as the charging apparatus 12 is moved from position to position. Alternatively, the treatment system 104 can be positioned on rails (not shown) to move with the charging apparatus 12 during positioning. A damper 116 is positioned in the conduit 106 to restrict or constrict the flow of gas therethrough and thereby regulate the flow of gas to the treatment system 104. The treatment system 104 can comprise a refractory lined post combustion chamber 108 and further treatment devices as disclosed in U.S. Pat. No. 6,155,333 and herein incorporated by reference.

FIG. 1 is perspective view of the steelmaking apparatus 10 showing the connector 22 engaging the furnace 14. FIGS. 2–4 respectively show the connector 22 in the charging, retracted and disconnected positions. The connector 22 provides an interface between the preheater 20 and the furnace 14 for discharging preheated charged materials into the furnace 14. The connector 22 is cylindrical and forms the terminal part of the conveyor 13. Accordingly, the connector 22 vibrates and moves with the conveyor 13.

The connector 22 is circular in cross section and has an inlet end 118 sealingly adjacent the preheater exit 94 and an outlet end 120 configured to be insertable into the electric arc furnace material opening 36. The connector 22 is preferably water cooled in order to withstand the high temperatures from the furnace 14.

During steel production, the circular connector 22 is introduced into the furnace 14 through the raw material entry opening 36. The circular connector 22 and the round material entry opening 36 allow the furnace 14 to be tapped without interruption of the steel production process. The connector 22 is not required to be withdrawn from the furnace 14 when the furnace 14 is tilted for tapping because the furnace 14 is tilted about a central axis 122 of the connector 22. The diameter of the connector 22 is of sufficient size to evacuate the first off gas for a given project capacity while keeping the flow rate of off gas preferably below ten meters per second. Because the material entry opening 36 and the connector 22 are circular, the heat from the furnace off gas is effectively transferred to the preheating chamber 98 and the desired system pressures are maintainable and controllable.

Since it is essential that the connector 22 be round where entering the furnace opening 36 so that the furnace 14 may be tilted and furnace off gas transferred to the preheating chamber 20, the conveyor transition segment 54 is used to convert the trapezoidal conveyor 13 to the semi-round conveyor 55. The transition segment 54 can be placed in any portion of the charging apparatus 12, but preferably is positioned within the preheater 20 as shown in FIG. 10. Further detailed in FIGS. 11–13, the transition segment 54 includes the trapezoidal conveyor 13 downstream and adjacent to the semi round conveyor 55 with a transitional member 126 extending from the trapezoidal conveyor 13 to the semi-round conveyor 55. The transitional member 126 is trapezoidal in configuration at a downstream end and transitions to a generally semi-circular configuration before engaging downstream the semi-round conveyor 55. The trapezoidal conveyor 13, transitional member 126 and semi-circular conveyor 55 are sections of one overall conveyor extending throughout the charging apparatus 12.

Optionally, gases and granulated material, such as for example slag reformers, can be injected into the charge material near the discharge end of the conveyor 13. When the transition segment 54 is located near the discharge end of the conveyor 13, additives are preferably introduced by a conduit 128 slightly downstream of where the transition from the trapezoidal conveyor 13 to the semi-round conveyor 55 is complete.

Figure 16:
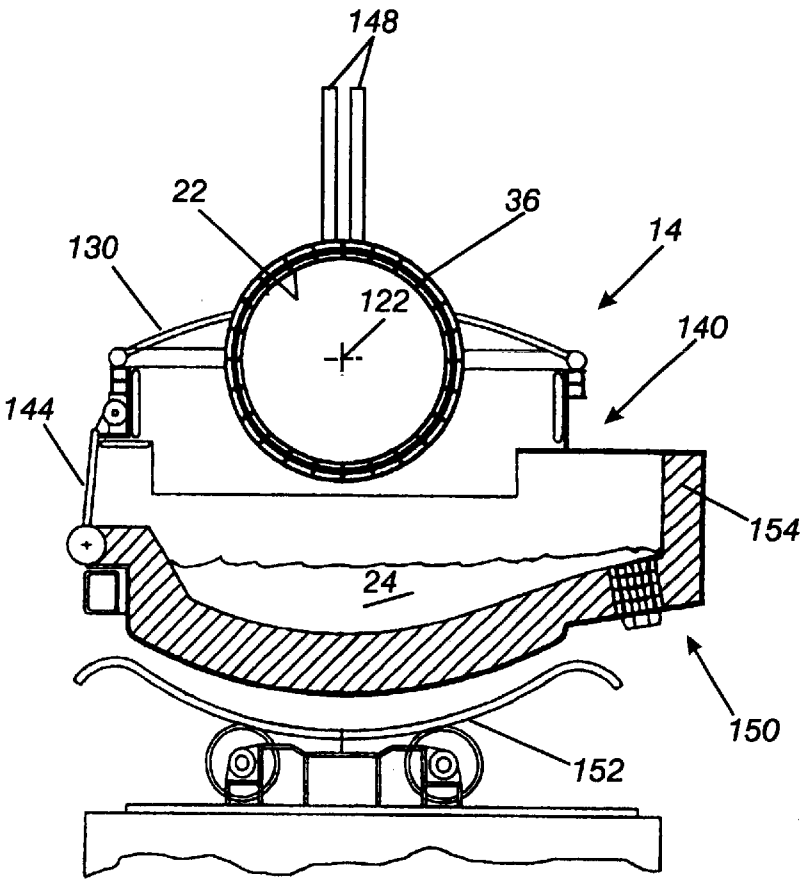
FIG. 16 is a front view, partially in cross section, of the furnace showing a furnace tilting mounting, the furnace material opening entry and a furnace tapping hole.
Figure 15:
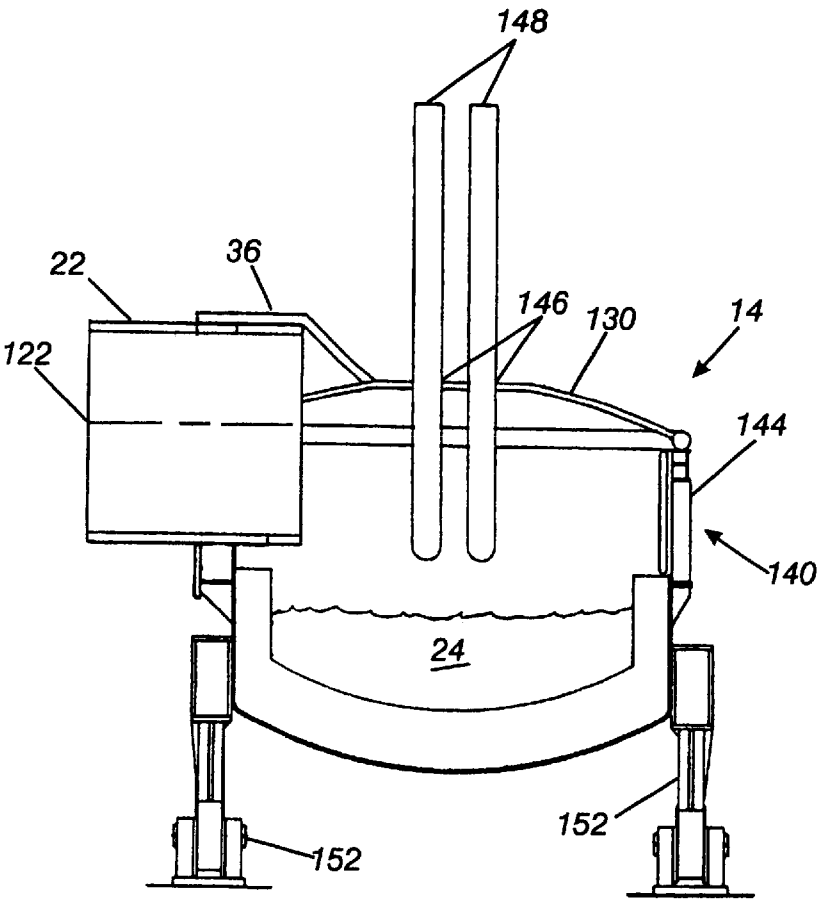
FIG. 15 is cross sectional side view of the melting furnace, which in this case is an electric arc furnace, showing the connector in the charging position fully inserted within the furnace material opening entry.

FIG. 1 is a perspective view of the steelmaking apparatus 10 showing the furnace 14 including the furnace roof 130, a shell 140 and the round entry opening 36. FIGS. 15 and 16 are cross sectional views respectively taken from the side and the front of the furnace 14. An upper portion 144 of the shell 140 may be refractory lined or water cooled. The furnace roof 130 center is refractory lined, and the furnace roof 130 has at least one opening 146 for receiving electrodes 148 therethrough.

The charging opening 36 extends from an opening from an upper shell portion 144 to a portion of the furnace roof 130 thereby resulting in a split entry. The charging opening 36 is preferably aligned with a tilting axis of the furnace so that the central axis 122 of the charging opening 36 shares the tilting axis of the furnace 14. Combination of the round charging opening 36 and the round connector 22 reduces the overall furnace height 14 and eliminates the accumulation of slag beneath the connector 22 during the melting-refining process. The furnace 14 further includes a four-roller device 152 for facilitating the tilting of the furnace 14 about its tilting axis 122.

FIG. 15 is a cross sectional side view of the furnace 14 with the connector 22 inserted into the furnace 14 in the charging position. Charge materials are transported from the preheater 22 to the connector 20 and into the furnace bath 24. The round configuration of the furnace opening 36 and the connector 22 allow for the reduction of the gap between the connector 22 and the opening 36 to avoid slag build-up on the interface between the connector 22 and furnace 14. Additionally, the round configuration allows the connector 22 to engage the furnace 14 during the entire campaign. Furthermore, the connector 22 can be simply positioned in the charging, retracted and disconnected positions by driving the charging apparatus 12 with the hydraulic cylinders 34. Disconnecting the connector 22 from the furnace 14 facilitates and simplifies the repair and maintenance of the connector 22.

The round split entry opening 36, with approximately half of the entry in the furnace roof 130, reduces the furnace 14 height, with resultant lower energy costs. Although the charging apparatus 12 is shown with a split entry electric arc furnace 14, the charging apparatus 12 can be used with other types of melt furnaces and as a substitution for a cupola in a cast iron foundry.

In aggregate, the charging apparatus 12 including the drive engine 42, loading section 16, dynamic gas seal 18 and preheater 20 is less than 40 meters, preferably less than 35 meters, and more preferably, about 30 or less meters.

SUMMARY OF THE ACHIEVEMENT OF THE OBJECTS OF THE INVENTION

From the forgoing, it is readily apparent that I have invented an improved apparatus for preheating, melting and refining steel that conserves energy, protects the environment, and is suitable for use in low production mini-mills and iron and steel foundries.

It is further apparent that the charging apparatus can be simply moved from a charging, to a retracted, to a disconnected position for operational purposes and in order to facilitate maintenance and repair of the charging apparatus.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed is:

1. A charging apparatus for continuous preheating, but not limited to, iron-bearing material for charging into a metal-treating furnace, said charging apparatus comprising:

a frame having wheels for longitudinal movement toward and away from said furnace;

an elongate conveyor having a front segment, an intermediate segment and a rear segment, said conveyor being mounted on said frame;

a loading section disposed at said front segment for receiving charge materials;

a generally closed preheater disposed at said intermediate segment for preheating charge materials on said conveyor; and connecting means disposed at said rear segment, longitudinally moveable with said conveyor, and adapted for longitudinal and removable insertion into an opening of the furnace for directly feeding the charge materials into the furnace.

2. The charging apparatus according to claim 1, further comprising a pair of fixed rails, said wheels being adapted to moveably engage said rails, and said connecting means is substantially round with a horizontal center-line.

3. The charging apparatus according to claim 2 wherein the charging section includes a skirt disposed above and along lateral sides of said conveyor.

4. The charging apparatus according to claim 3 wherein said skirt is attached to said frame for longitudinal movement with said conveyor.

5. The charging apparatus according to claim 3 wherein said preheater is provided with a hood which is positioned above said conveyor and is removably attached to said frame for longitudinal movement with said conveyor.

6. The charging apparatus according to claim 3 further including a dynamic gas seal having a hood which covers said conveyor, wherein said dynamic gas seal is disposed at said intermediate portion of said conveyor between said charging section and said preheater.

7. The charging apparatus according to claim 6 wherein said dynamic gas seal hood is removably attached to said frame for longitudinal movement with said conveyor.

8. The charging apparatus according to claim 2 further comprising means for moving said charging conveyor in both directions along said rails.

9. The charging apparatus according to claim 1 wherein said conveyor is a vibrating conveyor.

10. The charging apparatus according to claim 9 wherein the conveyor has a first end portion having a flat bottom, a second end portion having a semi-circular configuration, and a transitional portion connecting said first end portion to said second end portion.

11. The charging apparatus according to claim 9 wherein each of said conveyor segments are semi-circular.

12. The charging apparatus according to claim 1 wherein said conveyor comprises a single vibrating conveyor.

13. An apparatus for continuous preheating of an iron-bearing material for charging into a metal-treating furnace, said apparatus comprising:

a conveyor for receiving charge materials thereon;

a generally closed preheater for preheating the charge materials on said conveyor;

a metal treating furnace for melting and refining a metallic charge therein;

a connecting means coupled to said conveyor for directly feeding charge materials into said furnace, said connecting means having a horizontal centerline;

means for tilting said furnace about an axis of rotation coinciding substantially with said centerline of said connecting means; and said conveyor being mounted on wheels for longitudinal movement toward and from said furnace.

14. The apparatus according to claim 13 further comprising a pair of fixed rails, and wherein said wheels are rail wheels.

15. The apparatus according to claim 14 further comprising means for moving said conveyor in both directions along said rails.

16. The apparatus according to claim 13 wherein said conveyor is a single elongate vibrating channel.

17. The apparatus according to claim 13, further comprising a skirt partially surrounding said conveyer for directing charge materials onto said conveyer;

said preheater having a hood covering a portion of said conveyer; and said skirt and said hood being longitudinally movable toward and from said furnace with said conveyer.

* * * * *